US008368609B2

(12) United States Patent
Morrow et al.

(10) Patent No.: US 8,368,609 B2
(45) Date of Patent: Feb. 5, 2013

(54) OMNIDIRECTIONAL MULTIPLE INPUT MULTIPLE OUTPUT (MIMO) ANTENNAS WITH POLARIZATION DIVERSITY

(75) Inventors: Jarrett D. Morrow, Bow, NH (US); Adam M. Alevy, Carlisle, MA (US); Shawn W. Johnson, Allenstown, NH (US)

(73) Assignee: Laird Technologies, Inc., Earth City, MO (US)

( * ) Notice: Subject to any disclaimer, the term of this patent is extended or adjusted under 35 U.S.C. 154(b) by 859 days.

(21) Appl. No.: 12/512,969

(22) Filed: Jul. 30, 2009

(65) Prior Publication Data

US 2010/0097286 A1 Apr. 22, 2010

Related U.S. Application Data

(60) Provisional application No. 61/196,837, filed on Oct. 21, 2008.

(51) Int. Cl.
*H01Q 21/00* (2006.01)

(52) U.S. Cl. ..... 343/810; 343/816; 343/727

(58) Field of Classification Search ..... 343/727, 343/810, 816, 872

See application file for complete search history.

(56) References Cited

U.S. PATENT DOCUMENTS 6,201,510 B1 * 3/2001 Lopez et al. ..... 343/799
6,310,584 B1 * 10/2001 Reece et al. ..... 343/816
6,426,723 B1 7/2002 Smith et al.
7,868,842 B2 * 1/2011 Chair ..... 343/797
2007/0176829 A1 8/2007 Liu
2008/0129640 A1 6/2008 Shtrom et al.
2012/0098725 A1 * 4/2012 Lytle et al. ..... 343/797

FOREIGN PATENT DOCUMENTS

JP 3854211 B2 12/2006

OTHER PUBLICATIONS http://lairdtech.thomasnet.com/keyword/?key=all&keycateg=100&keyprod=&SchType=2&keyword=squint, 3 pages, printed Aug. 4, 2009.

Chinese office action dated Mar. 26, 2012 from Chinese patent application No. 200910205245.7; 9 pages. Chinese patent application No. 200910205245.7 and the instant application both claim priority to U.S. Appl. No. 61/196,837, filed Oct. 21, 2008.

* cited by examiner

*Primary Examiner* — Tan Ho

(74) *Attorney, Agent, or Firm* — Harness, Dickey & Pierce, P.L.C.

(57) ABSTRACT

Exemplary embodiments are provided of omnidirectional MIMO antennas with polarization diversity. In one exemplary embodiment, an omnidirectional MIMO antenna generally includes an array of radiating antenna elements having a linear horizontal polarization and radiating omnidirectionally in azimuth. The antenna also includes at least one radiating antenna element having a linear vertical polarization and radiating omnidirectionally in azimuth. The vertically polarized radiating antenna is spaced-apart from the array. The antenna is operable for producing omnidirectional, vertically polarized coverage for at least one port, as well as omnidirectional, horizontally polarized coverage for at least one other port.

22 Claims, 14 Drawing Sheets

| | |
|---|---|
| FREQUENCY (GHz) | 2.4-2.5 |
| GAIN WITH 60-INCH CABLE | 3 dBi NOMINAL |
| NUMBER OF ELEMENTS | 3 |
| VSWR | 2.0:1 |
| POLARIZATION | 2 LINEAR VERTICAL, 1 LINEAR HORIZONTAL |
| AZIMUTH BEAMWIDTH | OMNIDIRECTIONAL |
| ELEVATION BEAMWIDTH | 55 DEGREES NOMINAL |
| SIZE | 208 x 104 x 36 mm<br>8.2 x 4.2 x 1.4 INCHES |
| POWER | 2 W |

FIG. 5

OMNIDIRECTIONAL MULTIPLE INPUT MULTIPLE OUTPUT (MIMO) ANTENNAS WITH POLARIZATION DIVERSITY

CROSS-REFERENCE TO RELATED APPLICATION

This application claims the benefit of U.S. Provisional Application No. 61/196,837 filed Oct. 21, 2008. The entire disclosure of the above application is incorporated herein by reference.

FIELD

The present disclosure relates to omnidirectional MIMO antennas with polarization diversity.

BACKGROUND

This section provides background information related to the present disclosure which is not necessarily prior art.

Generally, an omnidirectional antenna is an antenna that radiates power generally uniformly in one plane with a directive pattern shape in a perpendicular plane, where the pattern is often described as "donut shaped."

MIMO antennas generally use multiple antennas at both the transmitter and receiver to improve communication performance. MIMO antennas are commonly used in wireless communications, since MIMO antennas may offer significant increases in data throughput and link range without additional bandwidth or transmit power. Existing MIMO antennas provide linear vertical polarization on all ports.

SUMMARY

This section provides a general summary of the disclosure, and is not a comprehensive disclosure of its full scope or all of its features.

According to various aspects, exemplary embodiments are disclosed of omnidirectional MIMO antennas with polarization diversity. In an exemplary embodiment, an omnidirectional MIMO antenna generally includes an array of radiating antenna elements having a linear horizontal polarization and radiating omnidirectionally in azimuth. The antenna also includes at least one radiating antenna element having a linear vertical polarization and radiating omnidirectionally in azimuth. The vertically polarized radiating antenna is spaced-apart from the array. The antenna is operable for producing omnidirectional, vertically polarized coverage for at least one port, as well as omnidirectional, horizontally polarized coverage for at least one other port.

DRAWINGS

The drawings described herein are for illustrative purposes only of selected embodiments and not all possible implementations, and are not intended to limit the scope of the present disclosure in any way.

FIG. 5 is a table setting forth exemplary operational parameters, characteristics, features, and dimensions for the antenna 100 shown in FIG. 1, which are provided for purposes of illustration only according to exemplary embodiments;

Figure 1:
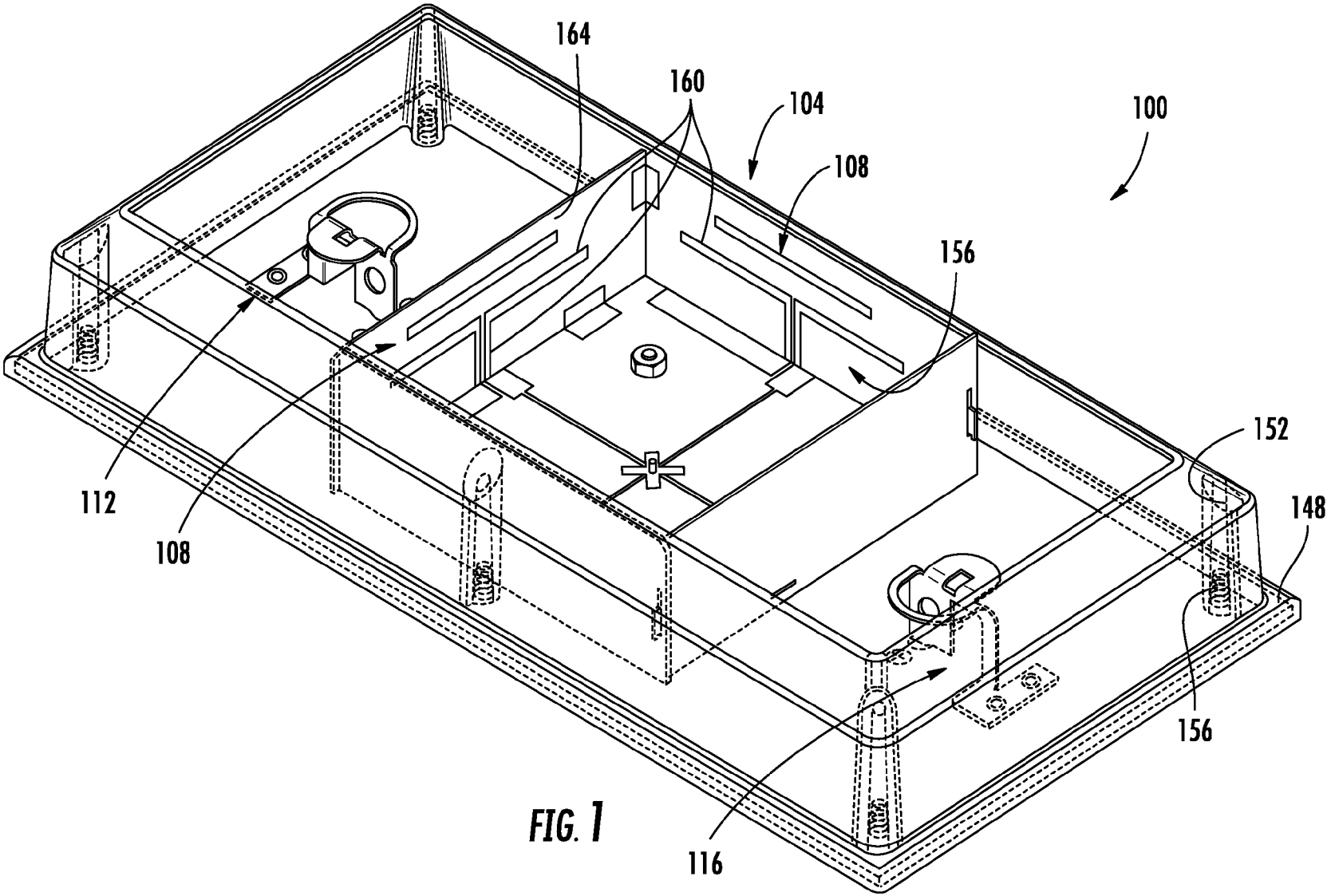
FIG. 1 is a perspective view of an omnidirectional MIMO antenna, according to an exemplary embodiment of the present disclosure, where the internal antenna components (typically covered and hidden from view by the radome) are shown for clarity.
Figure 6A:
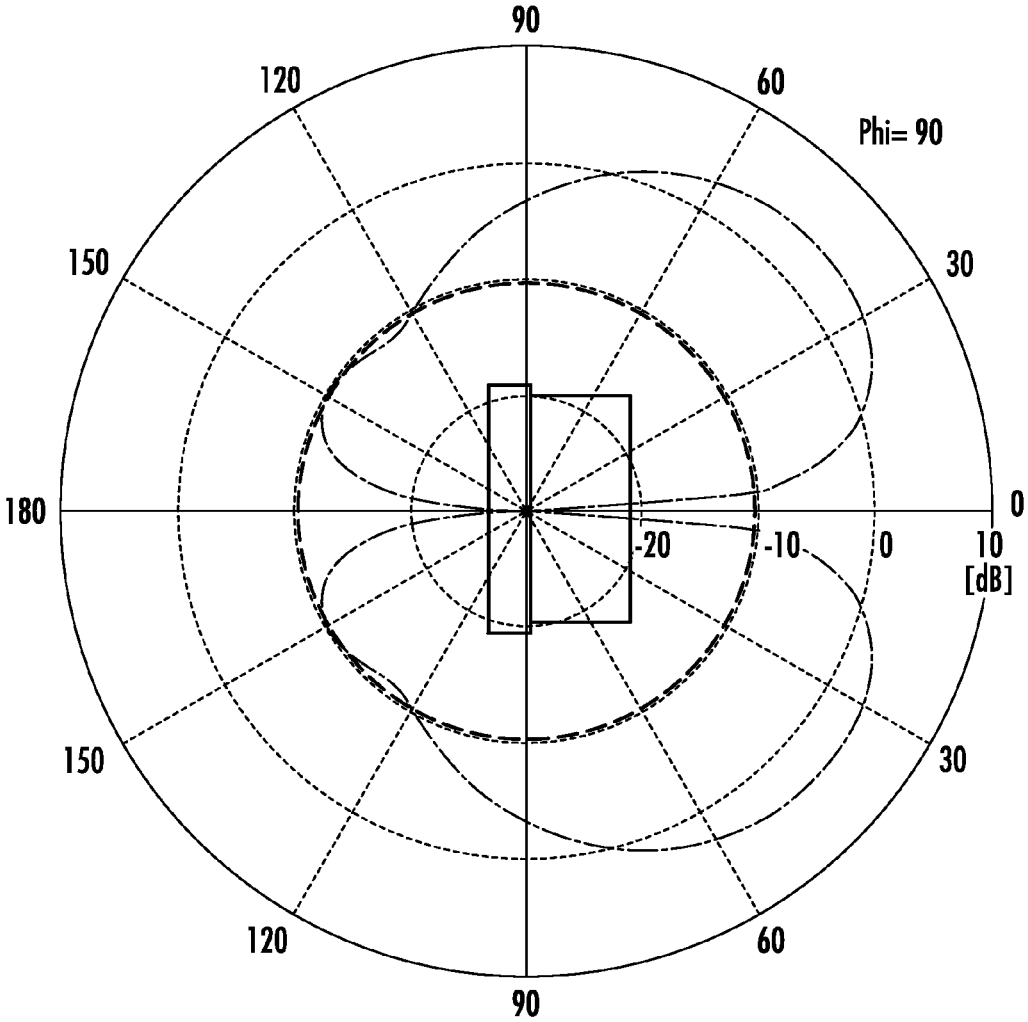
Figure 6B:
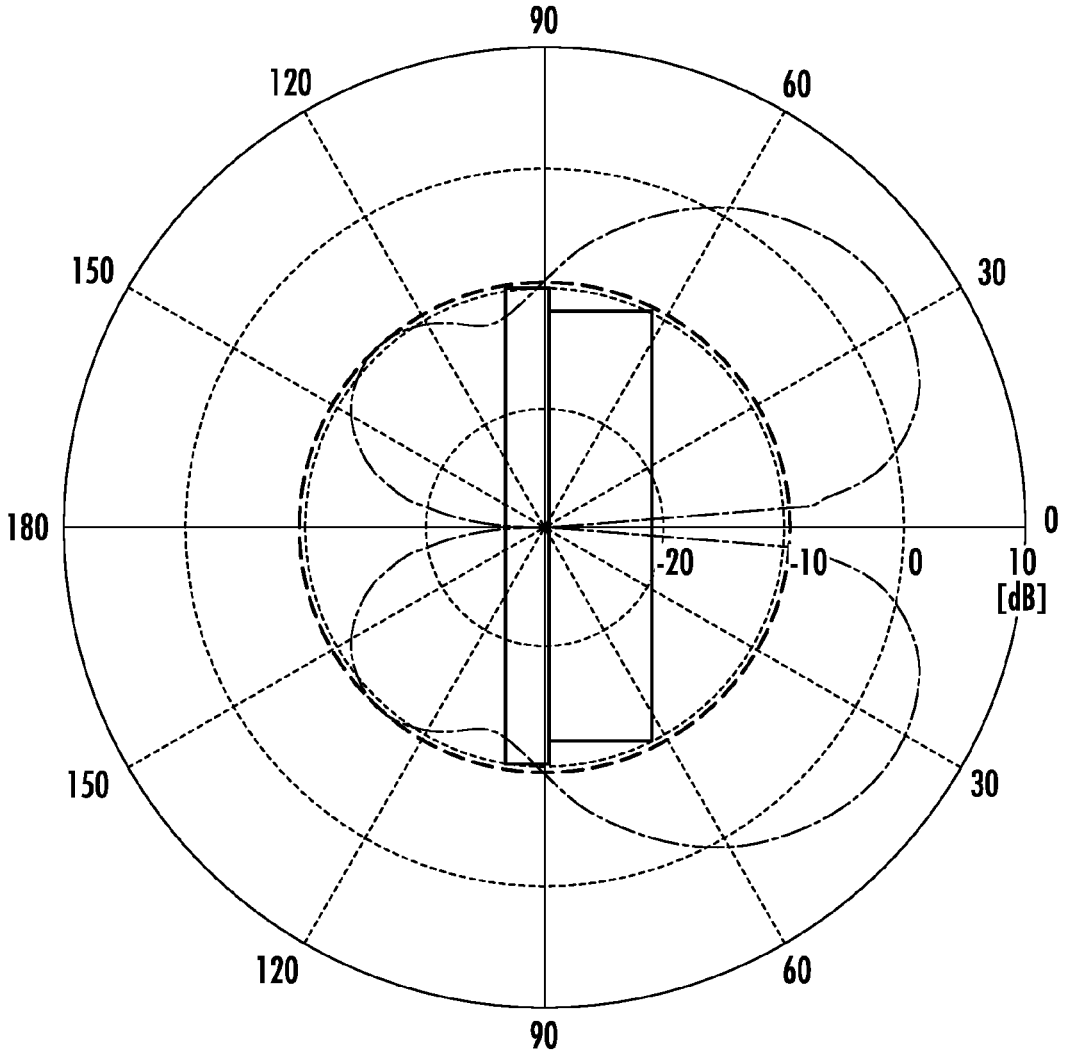
Figure 7:
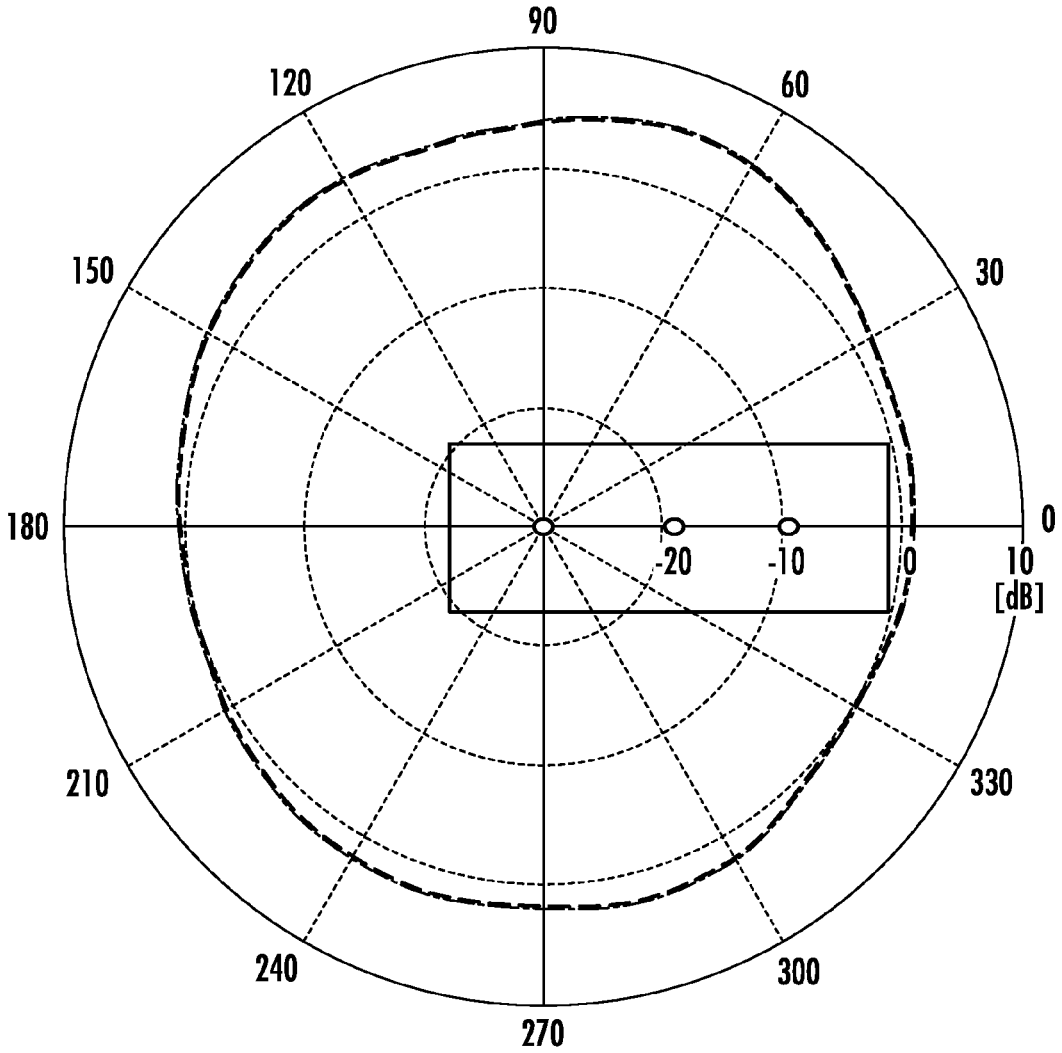
Figure 8A:
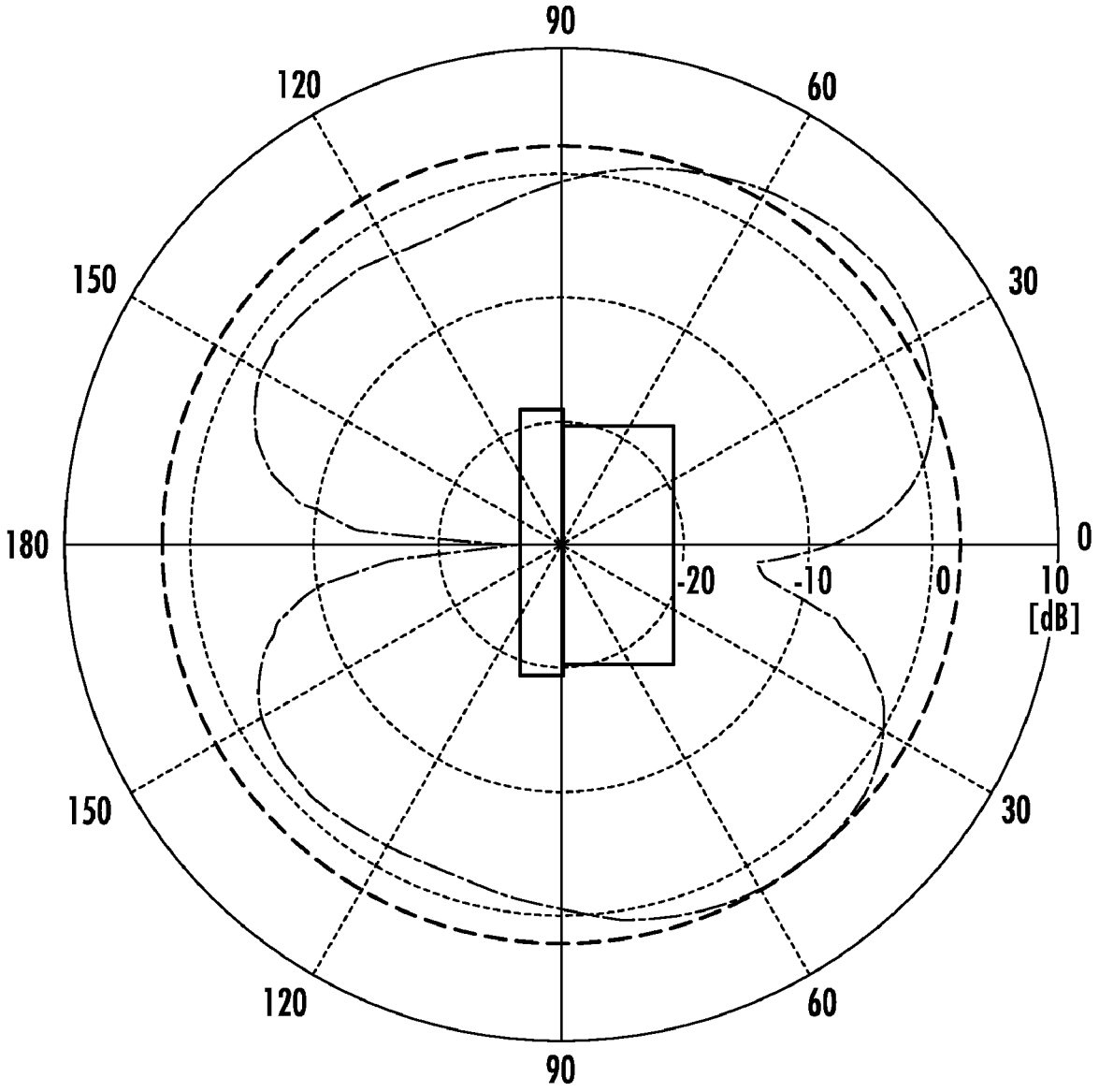
Figure 8B:
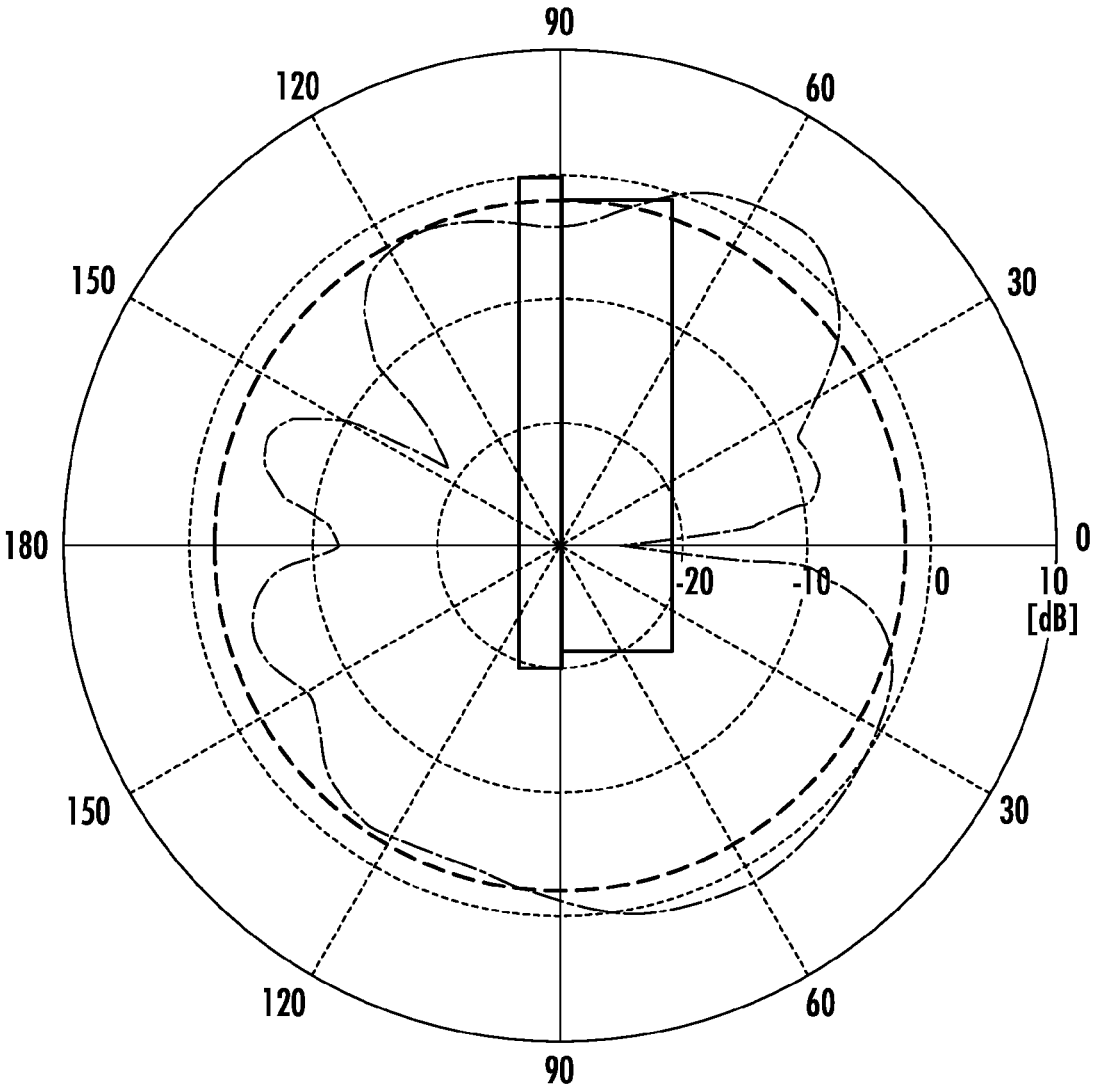
Figure 9:
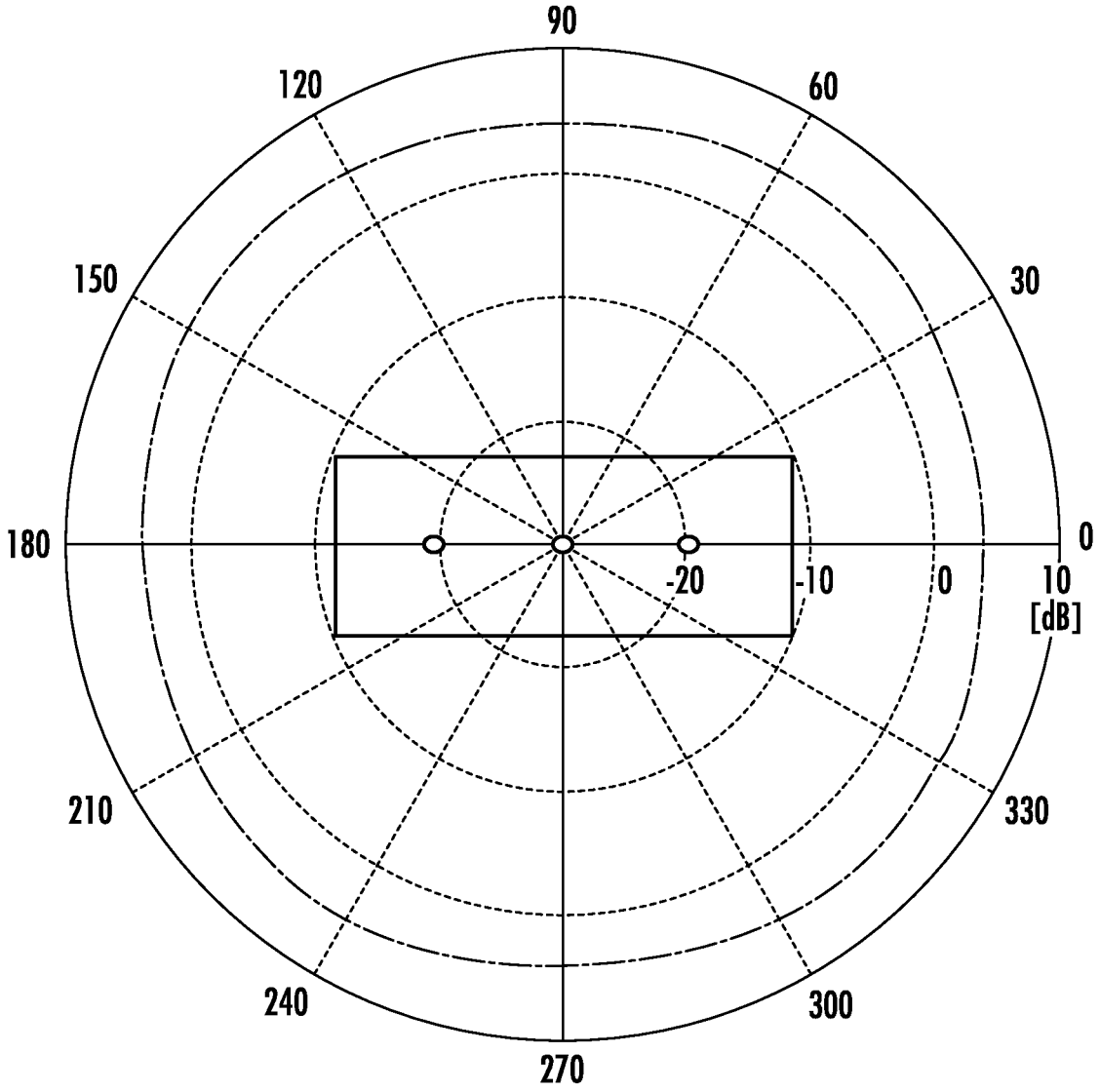
Figure 10:
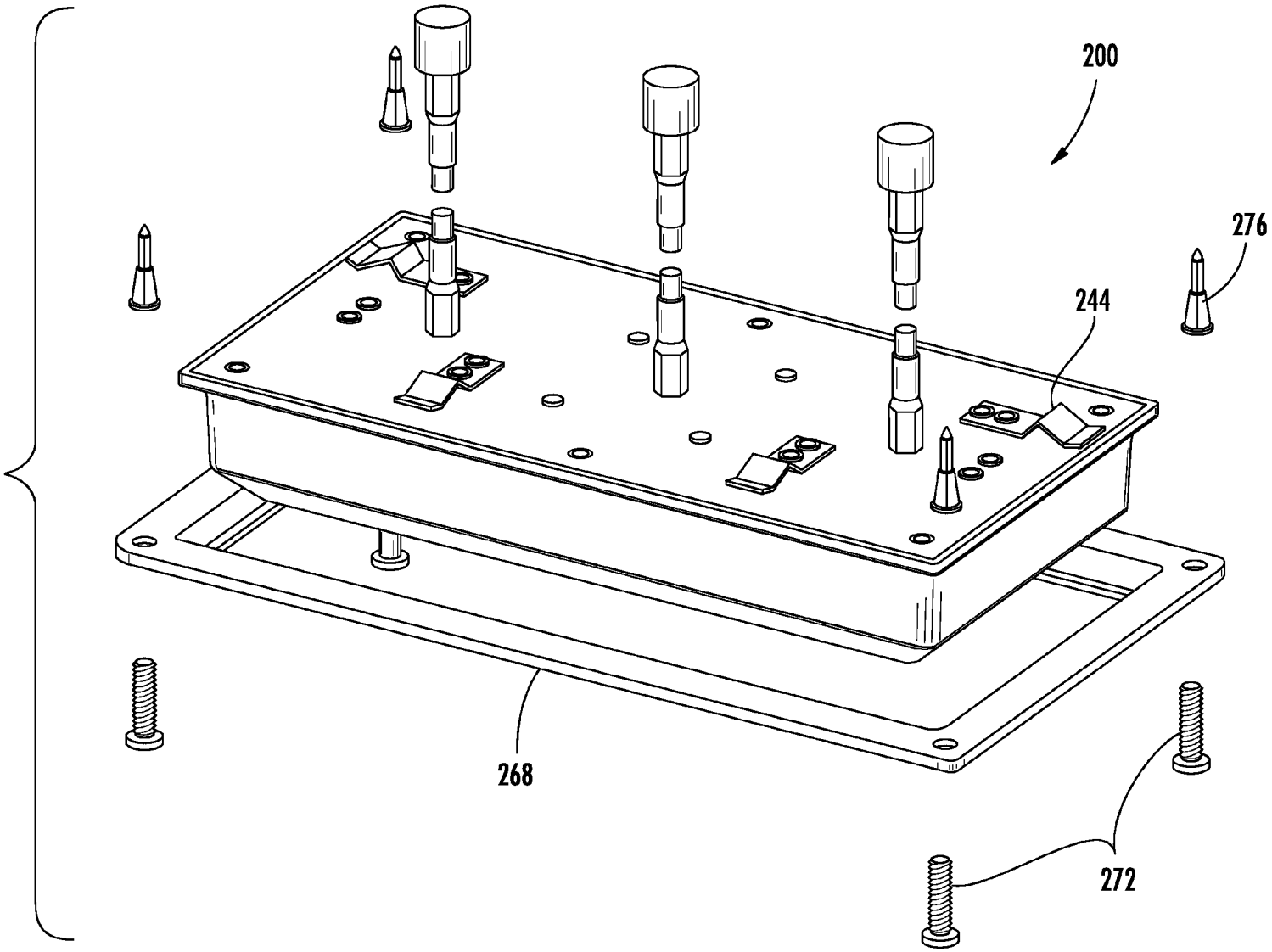
Figure 11:
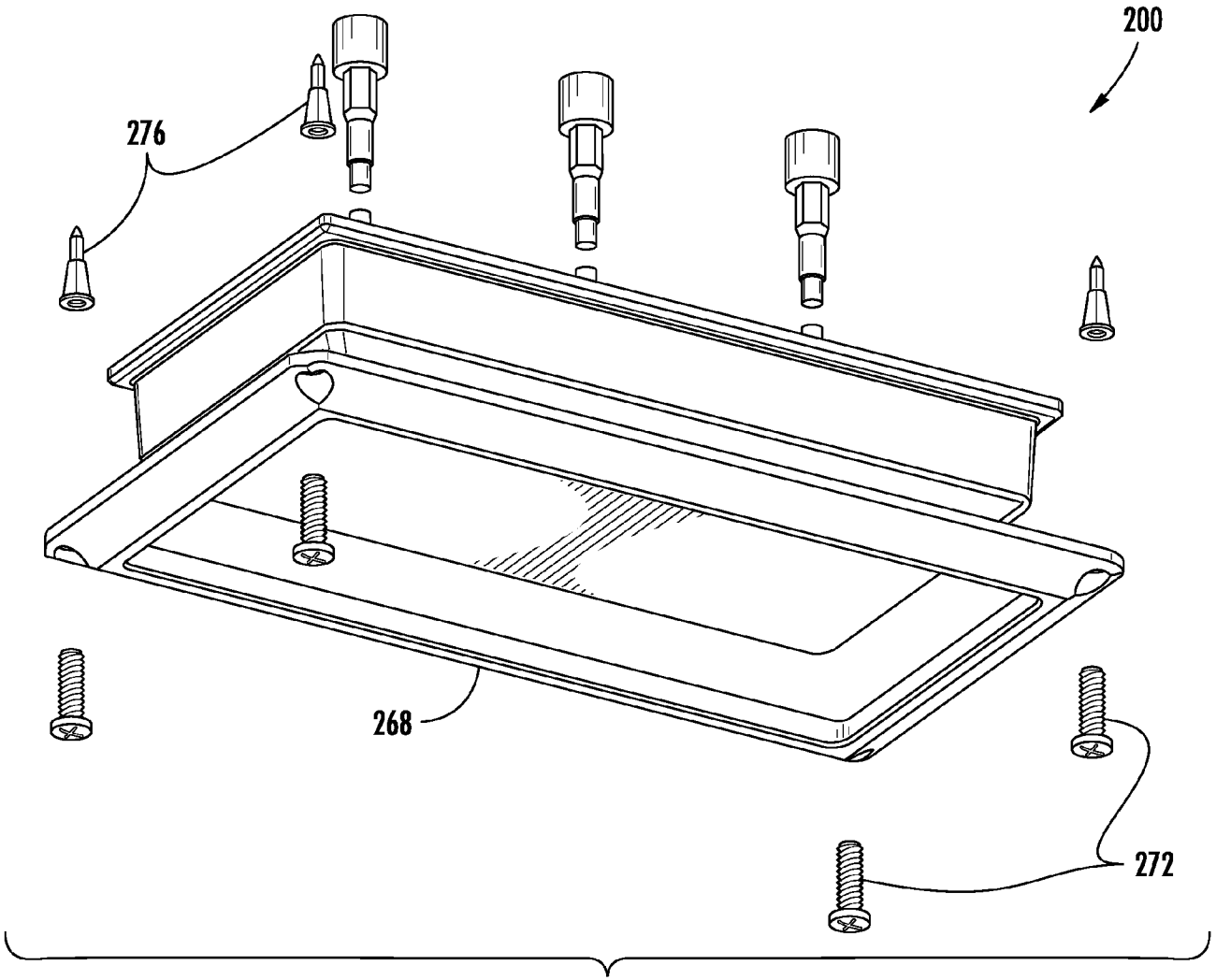
Figure 12:
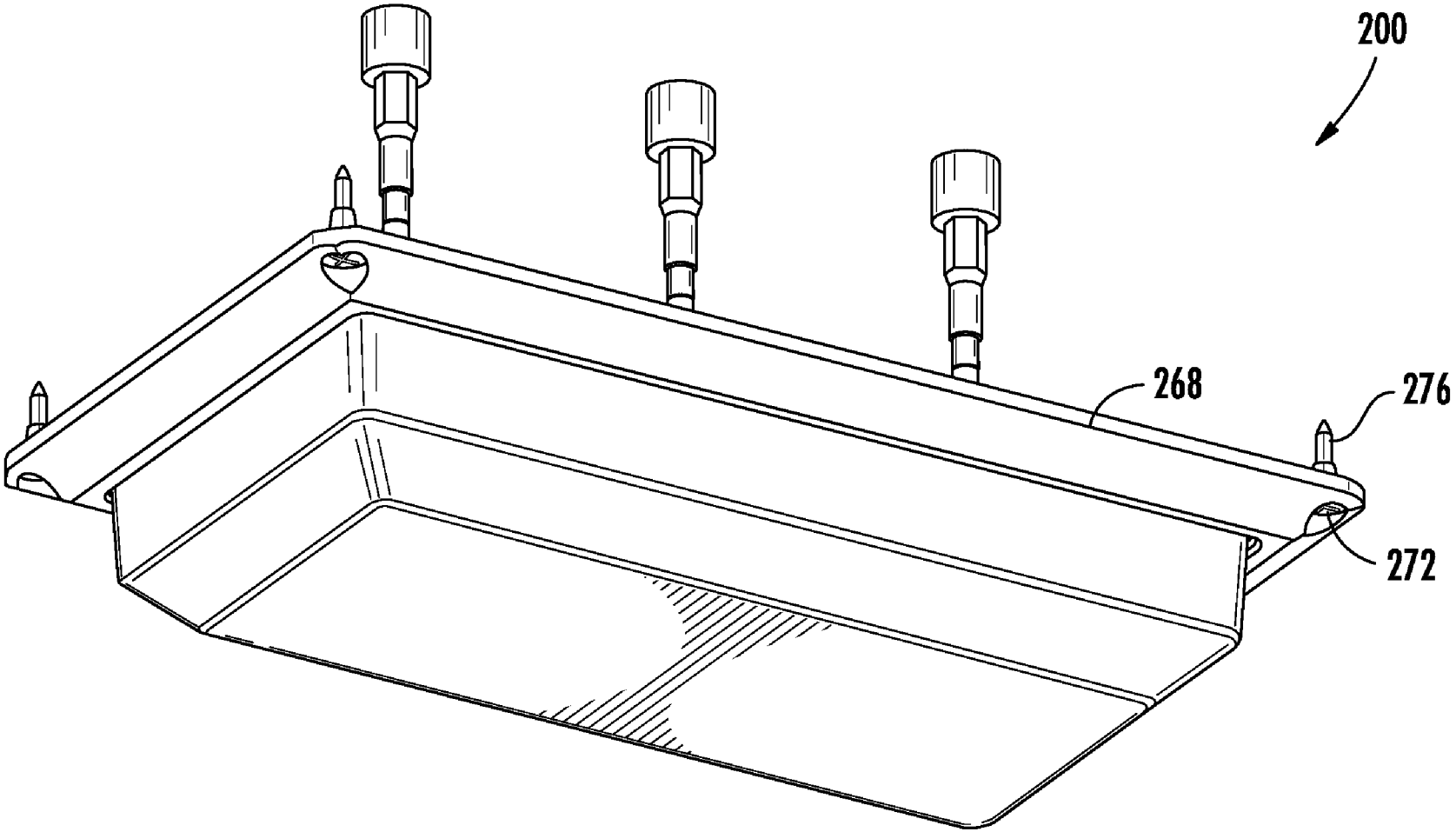
Figure 13:
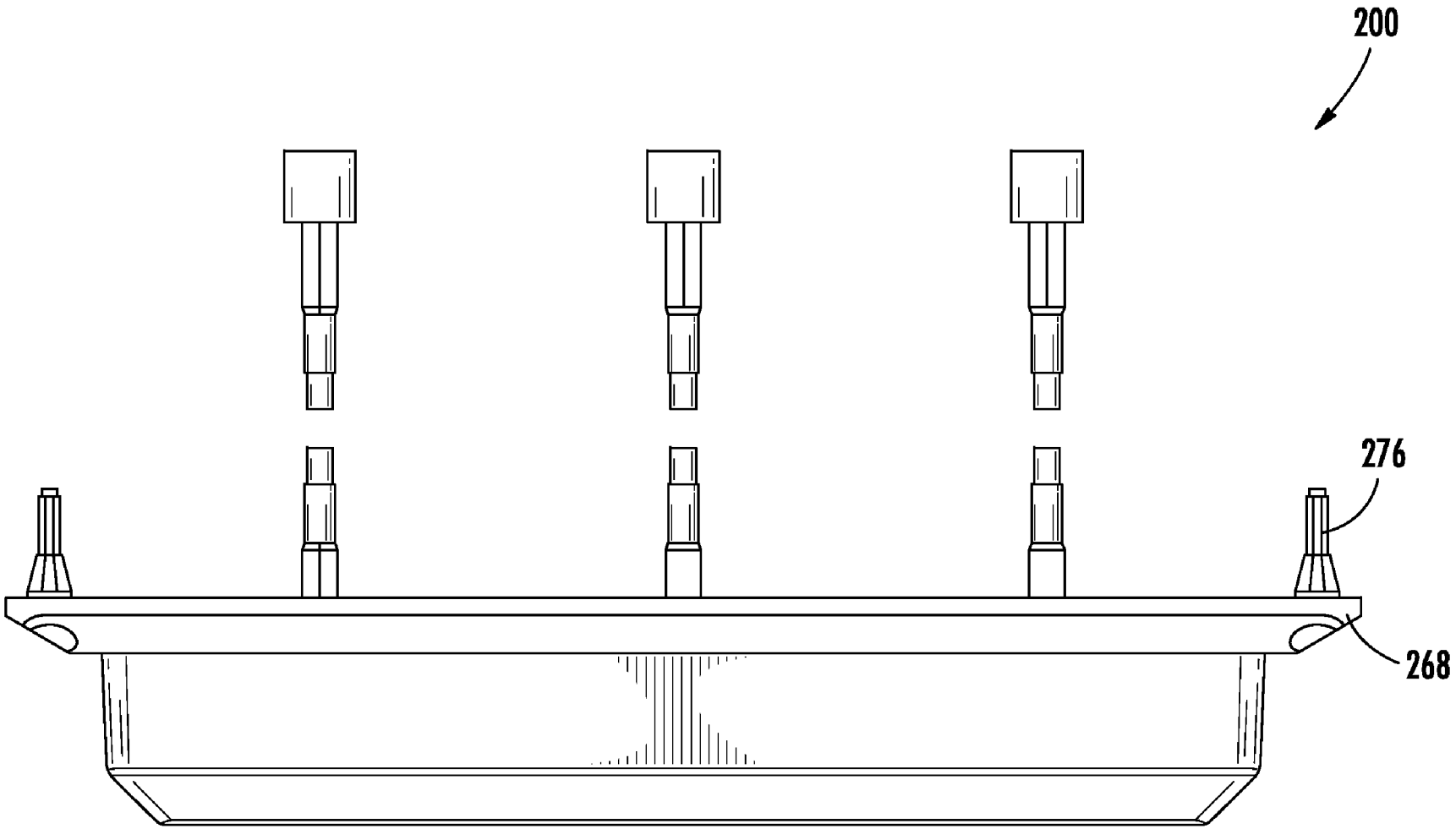

FIGS. 6A and 6B illustrate exemplary H-Plane (elevation) radiation patterns (where the radiation patterns are shown in broken lines and were simulated in an RF Electromagnetic software tool) for the exemplary horizontally polarized element of the antenna shown in FIG. 1 at a frequency of 2.45 Gigahertz, where an illustration of the antenna is superimposed on the graph to help clarify the antenna orientation relative to the radiation patterns (which radiation patterns are shown in broken lines, as the dashed line in bold forming a circle is used in the software to help visualize and report some other parameters of the pattern performance);

FIG. 7 illustrates an exemplary H-Plane (azimuth 45 degrees from horizon) radiation pattern (simulated in an RF Electromagnetic software tool) for the exemplary vertically polarized element of the antenna shown in FIG. 1 at a frequency of 2.45 Gigahertz, where an illustration of the antenna is superimposed on the graph to help clarify the antenna orientation relative to the radiation pattern;

FIGS. 8A and 8B illustrate exemplary E-Plane (elevation) radiation patterns (which radiation patterns are shown in broken lines and were simulated in an RF Electromagnetic software tool) for the exemplary vertically polarized element of the antenna shown in FIG. 1 at a frequency of 2.45 Gigahertz, where an illustration of the antenna is superimposed on the graph to help clarify the antenna orientation relative to the radiation patterns (which radiation patterns are shown in broken lines, as the dashed line in bold forming a circle is used in the software to help visualize and report some other parameters of the pattern performance);

FIG. 9 illustrates an exemplary E-Plane (azimuth at 45 degrees from the horizon) radiation pattern (simulated in an RF Electromagnetic software tool) for the exemplary horizontally polarized element of the antenna shown in FIG. 1 at a frequency of 2.45 Gigahertz, where an illustration of the antenna is superimposed on the graph to help clarify the antenna orientation relative to the radiation pattern;

FIG. 10 is a perspective view of an omnidirectional MIMO antenna, according to another exemplary embodiment of the present disclosure, and illustrating a frame-style mount that may be used for mounting the antenna to a wallboard or other non-gridded ceiling system;

FIG. 11 is another perspective view of the antenna shown in FIG. 10;

FIG. 12 is another perspective view of the antenna shown in FIG. 10 and illustrating the frame-style mount (and screws and anchor members) assembled to the antenna according to exemplary embodiments; and FIG. 13 is a side view of the antenna shown in FIG. 12.

DETAILED DESCRIPTION

In the following description, numerous specific details are set forth such as examples of specific components, devices, methods, in order to provide a thorough understanding of embodiments of the present disclosure. It will be apparent to a person of ordinary skill in the art that these specific details need not be employed, and should not be construed to limit the scope of the disclosure. In the development of any actual implementation, numerous implementation-specific decisions must be made to achieve the developer's specific goals, such as compliance with system-related and business-related constraints. Such a development effort might be complex and time consuming, but is nevertheless a routine undertaking of design, fabrication and manufacture for those of ordinary skill.

According to various aspects, exemplary embodiments are disclosed of omnidirectional MIMO antennas with polarization diversity. In an exemplary embodiment, an omnidirectional MIMO antenna generally includes an array of radiating antenna elements having a linear horizontal polarization and radiating omnidirectionally in azimuth. The antenna also includes at least one radiating antenna element having a linear vertical polarization and radiating omnidirectionally in azimuth. The vertically polarized radiating antenna is spaced-apart from the array. The antenna is operable for producing omnidirectional, vertically polarized coverage for at least one port, as well as omnidirectional, horizontally polarized coverage for at least one other port.

In some exemplary embodiments, the antenna includes three ports, two vertically polarized antenna elements, and an array of four horizontally polarized dipole elements. In such embodiments, the antenna may be operable for producing omnidirectional, vertically polarized coverage for two of the antenna's three ports. The antenna may also be operable for producing omnidirectional, horizontally polarized coverage for the third port.

In other exemplary embodiments, the antenna includes three ports, one vertically polarized antenna elements, and two arrays each having four horizontally polarized dipole elements. In such embodiments, the antenna may be operable for producing omnidirectional, horizontally polarized coverage for two of the antenna's three ports. The antenna may also be operable for producing omnidirectional, vertically polarized coverage for the third port.

Accordingly, various exemplary embodiments disclosed herein have a dual-polarized design that may provide reduced coupling of the radiating antenna elements and allows for closer spacing of the radiating antenna elements and smaller size. Various exemplary embodiments disclosed herein may also provide enhanced performance compared with standard market products. And, as compared to some existing MIMO antennas that provide vertical polarization on all ports, various exemplary embodiments disclosed herein may include vertically polarized radiating antenna elements and horizontally polarized radiating elements in various configurations to enhance MIMO performance through polarization diversity.

Various exemplary embodiments include omnidirectional MIMO antennas in which each port is provided with omnidirectional vertically or horizontally polarized coverage, and there is spatial separation of the horizontally polarized radiating antenna elements from the vertically polarized radiating antenna elements. In such exemplary embodiments, the horizontally polarized radiating antenna elements are thus not co-located with the vertically polarized radiating antenna elements. Accordingly, in such embodiments, there is both polarization diversity and spatial diversity.

In various exemplary embodiments, the horizontally polarized radiating antenna elements and the vertically polarized radiating antenna elements may be housed in relatively low profile ceiling-mountable or tabletop appropriate packages. Example layouts include linear antenna element groupings, triangular antenna element groupings, although other configurations are possible which increase in number as the number of radiating antenna elements increase.

As recognized by the inventors hereof, spatial separation/diversity and reduced coupling of radiating antenna elements are parameters that should be considered, although the rich scattering seen in indoor WLAN environments introduces depolarization. Accordingly, a MIMO system that includes one or more of the embodiments of the omnidirectional MIMO antenna disclosed herein may benefit from antenna polarization diversity. By way of example, an omnidirectional MIMO antenna disclosed herein may be used in systems and/or networks such as those associated with wireless internet service provider (WISP) networks, broadband wireless access (BWA) systems, wireless local area networks (WLANs), cellular systems, etc. The antenna assemblies may receive and/or transmit signals from and/or to the systems and/or networks within the scope of the present disclosure.

FIG. 1 illustrates an omnidirectional MIMO antenna 100 embodying one or more aspects of the present disclosure. As shown, the antenna 100 includes an array 104 of radiating antenna elements 108 having a linear horizontal polarization and radiating omnidirectionally in azimuth. The antenna 100 also includes two radiating antenna elements 112, 116 that are spaced-apart from the array 104. Each radiating antenna element 112, 116 has a linear vertical polarization and radiates omnidirectionally in azimuth.

Figure 2:
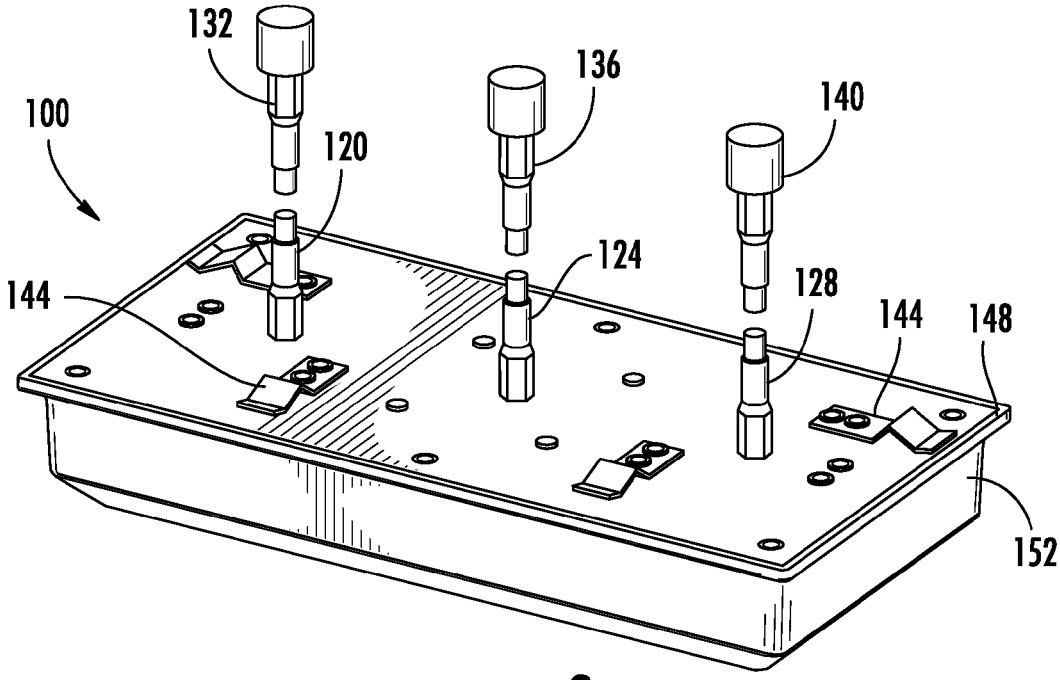
FIG. 2 is a perspective view of the omnidirectional MIMO antenna of FIG. 1, and further illustrating the antenna's ceiling-mounting clips and three ports.
Figure 3:
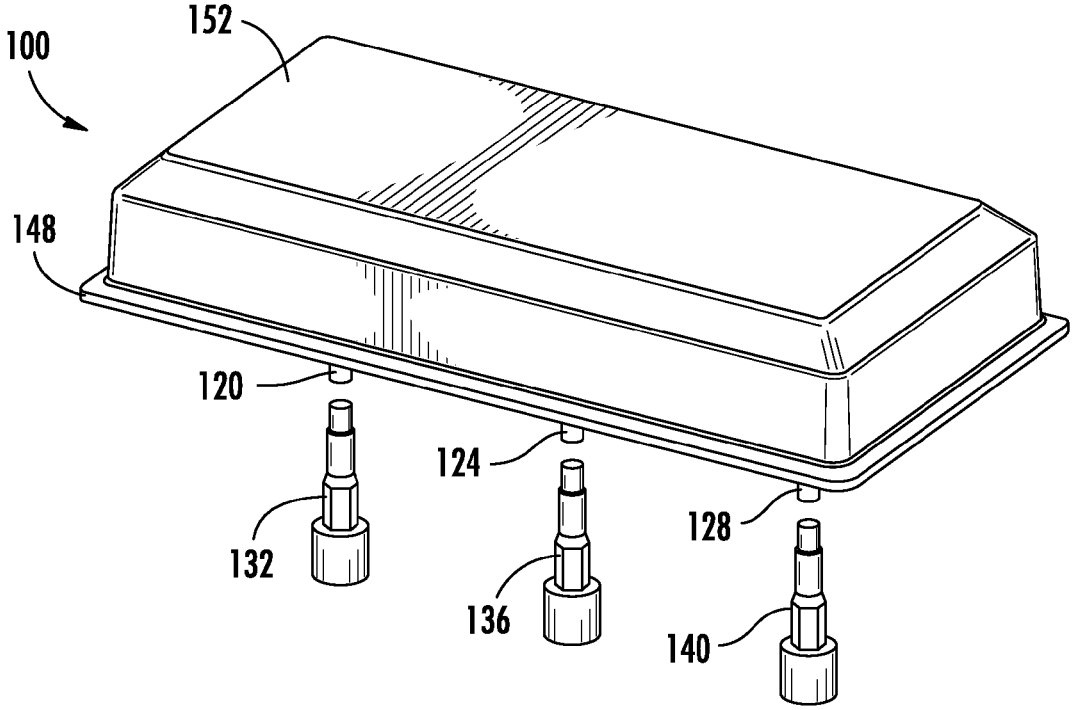
FIG. 3 is a perspective view of the antenna of FIGS. 1 and 2, and illustrating the radome.

As shown in FIGS. 2 and 3, the antenna 100 also includes three ports 120, 124, and 128 that are generally linearly aligned in a row with the second or middle port 124 between and generally equidistant from each of the other two ports 120, 128. For this particular illustrated embodiment, the antenna 100 produces omnidirectional, horizontally polarized coverage for the middle port 124 and omnidirectional, vertically polarized coverage for the outer ports 120, 128. More specifically, the array 104 of radiating antenna elements 108 operable for producing or providing omnidirectional, horizontally polarized coverage for the middle port 124, while the two radiating vertically polarized antenna elements 112, 116 are each operable for producing or providing omnidirectional, vertically polarized coverage for the respective outer ports 120, 128. Alternative embodiments may include different configurations for the ports (e.g., ports positioned in a non-linear arrangement, ports positioned in a triangular arrangement, etc.) and/or more or less than three ports.

Other embodiments may include different polarizations for the ports. For example, another exemplary embodiment of an omnidirectional MIMO antenna may produce omnidirectional, horizontally polarized coverage for the two outer ports and omnidirectional, vertically polarized coverage for the middle port. In this example, the antenna may include a first array of radiating antenna elements having a linear horizontal polarization and radiating omnidirectionally in azimuth, a second array of radiating antenna elements having a linear horizontal polarization and radiating omnidirectionally in azimuth, and a vertically polarized radiating antenna element spaced apart from and generally between the first and second arrays.

In this illustrative example, the antenna 100 provides each port 120, 124, 128 with omnidirectional coverage. Alternative embodiments may include one or more ports that are not provided with omnidirectional coverage.

Each port 120, 124, 128 is shown in FIGS. 2 and 3 in alignment with a corresponding electrical connector 132, 136, 140. The ports 120, 124, 128 may be configured for a pluggable connection to the electrical connectors 132, 136, 140 for communicating signals received by the antenna 100 to another device. Exemplary types of electrical connections that may be used include coaxial cable connectors, ISO standard electrical connectors, Fakra connectors, SMA connectors, an I-PEX connector, a MMCX connector, etc.

Figure 4:
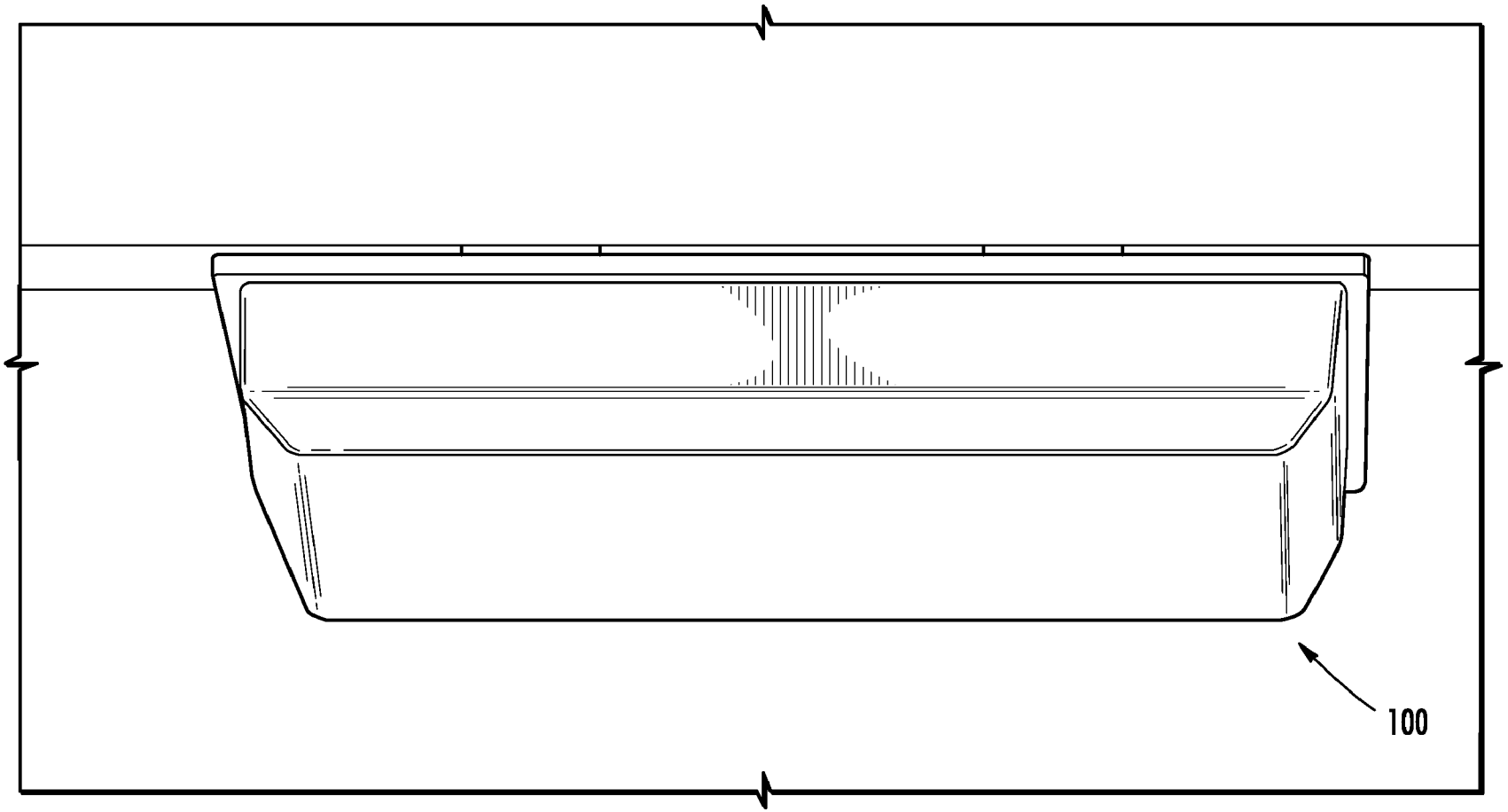
FIG. 4 is a perspective view of the antenna of FIGS. 1 through 3 mounted to a ceiling via the ceiling-mounting clips shown in FIG. 3.

With reference to FIGS. 2 and 4, the antenna 100 may be mounted to and suspended from a ceiling (FIG. 4) via ceiling mounting clips 144 (FIG. 2). As shown in FIG. 2, a mounting clip 144 is provided along each of the four sides of the antenna 100. Alternative embodiments may include more or less than four clips and/or other means (e.g., differently configured mounting clips, mechanical fasteners, adhesives, frame-style mounts, etc.) for mounting and suspending the antenna from a ceiling or other suitable structure. For example, FIGS. 10 through 13 illustrate another exemplary embodiment of an omnidirectional MIMO antenna 200 that includes a frame-style mount that may be used for mounting the antenna 200 to a wallboard or other non-gridded ceiling system. As shown in FIG. 10, this exemplary embodiment includes a frame 268, screws 272, and anchor members 276 that may be used for mounting and suspending the antenna 200 from a wallboard or non-gridding ceiling system. This exemplary embodiment also includes mounting clips 244, which may be used for mounting the antenna 200 to gridded ceiling system or other supporting structure. While FIG. 10 illustrates an embodiment that includes both the mounting clips 244 and frame style mount, other embodiments may include only the frame style mount without any mounting clips 244. Still other embodiments may be configured for positioning on a tabletop or other support surface, in which case, the antenna in such embodiments may not include any mounting clips or frame style mount.

The illustrated antenna assembly 100 generally includes a chassis or plate 148 (broadly, a support member) and a radome or housing 152 removably mounted to the chassis 148. The radome 152 may help protect the components of the radiating antenna elements 108, 112, and 116 (and other antenna components) enclosed within the internal space defined by the radome 152 and chassis 148. The radome 152 may also provide an aesthetically pleasing appearance to the antenna 100. Other embodiments may include radomes and covers configured (e.g., shaped, sized, constructed, etc.) differently than disclosed herein within the scope of the present disclosure.

The radome 152 may be attached to the chassis 148 by mechanical fasteners 156 (e.g., screws, other fastening devices, etc.). Alternatively, the radome 152 may be snap fit to the chassis 148 or via other suitable fastening methods/means within the scope of the present disclosure.

A wide range of materials, configurations (e.g., sizes, shapes, constructions, etc.), and manufacturing processes may be used for the chassis 148 (which may also or instead be referred to as a ground plane) and radome 152. In various exemplary embodiments, the radome 152 is injection molded plastic or vacuum formed out of thermoplastic, and the chassis or ground plane 148 may be electroconductive (e.g., aluminum, etc.) for electrically grounding the radiating antenna elements.

For the antenna 100 illustrated in FIG. 1, the radiating antenna elements 108 of the array 104 comprise horizontally polarized dipole elements. In addition, the antenna 100 also includes a feed network 156 for feeding the horizontally polarized dipole elements. In this example, the feed network 156 (e.g., microstrip transmission line, twin-line transmission line, etc.) and the horizontally polarized dipole elements comprise traces 160 on a printed circuit board 164. This is but one example of a type of feed that may be used with the antenna 100, as other types of feeds may be used in other embodiments. Alternative feed networks may also be used, such as other microstrip transmission lines, serial or corporate feeding networks, etc.

With further reference to FIG. 1, the array 104 includes four horizontally polarized dipole elements disposed on opposite sides or walls, which, in turn, are in generally rectangular configuration. Each horizontally polarized dipole element generally faces another dipole element and is generally orthogonal to the other two dipole elements. Alternative embodiments may include arrays with different configurations, such as more or less than four dipole elements and/or dipole elements in different orientations relative to each other than what is shown in FIG. 1.

Some embodiments may include one or more vertically polarized antenna elements that are identical or substantially similar to a vertically polarized antenna element of the Cushcraft™ Squint™ antenna. Alternative embodiments may include vertically polarized antenna elements having a different configuration than what is shown in FIG. 1. By way of general background, Squint™ antennas are designed to radiate vertically polarized energy when mounted on an electrically-conductive ground plane. The antenna is designed as a shorted, loaded monopole element. The resonant frequency of the antenna is determined by the total height and phase length from the feed point to the ground. The impedance of the antenna is a function of the ratio between the two flat sections at the feed point and grounding section. The compact structure and monopole configuration allow it to be relatively easily integrated into a housing to be mounted on the ceiling (for downward looking radiation) or mounted to a vehicle or other flat surface facing upwards (for upward looking radiation). The antenna may be relatively easily manufactured using stamping die and press. The feedpiont of the antenna may be attached to a RF source either through a coaxial transmission line from a cable or connector, or from a microstrip transmission line.

FIG. 5 is a table setting forth exemplary operational parameters, characteristics, features, and dimensions for the antenna 100 shown in FIG. 1, which are provided for purposes of illustration only and not for purposes of limitation. In alternative embodiments, an omnidirectional MIMO antenna may include none of or less than all of what is set forth in FIG. 5. For example, other embodiments of an omnidirectional MIMO antenna may be dimensionally sized larger or smaller than what is disclosed in FIG. 5. Further embodiments may include a voltage standing wave ratio greater than or less than 2:1 for an operating frequency between about 2.4 GHz and 2.5 GHz (or over a wider band to provide utility for WiMax (Worldwide Interoperability for Microwave Access) and other BWA (broadband wireless access) systems).

FIGS. 6A and 6B illustrate exemplary H-Plane (elevation) radiation patterns (simulated in an RF Electromagnetic software tool) for the exemplary horizontally polarized element of the antenna 100 shown in FIG. 1 at a frequency of 2.45 Gigahertz, where an illustration of the antenna is superimposed on the graph to help clarify the antenna orientation relative to the radiation patterns. FIG. 7 illustrates an exemplary H-Plane (azimuth 45 degrees from horizon) radiation pattern (simulated in an RF Electromagnetic software tool) for the exemplary vertically polarized element of the antenna 100 shown in FIG. 1 at a frequency of 2.45 Gigahertz, where an illustration of the antenna is superimposed on the graph to help clarify the antenna orientation relative to the radiation pattern. FIGS. 8A and 8B illustrate exemplary E-Plane (elevation) radiation patterns (simulated in an RF Electromagnetic software tool) for the exemplary vertically polarized element of the antenna 100 shown in FIG. 1 at a frequency of 2.45 Gigahertz, where an illustration of the antenna is superimposed on the graph to help clarify the antenna orientation relative to the radiation patterns. FIG. 9 illustrates an exemplary E-Plane (azimuth at 45 degrees from the horizon) radiation pattern (simulated in an RF Electromagnetic software tool) for the exemplary horizontally polarized element of the antenna 100 shown in FIG. 1 at a frequency of 2.45 Gigahertz, where an illustration of the antenna is superimposed on the graph to help clarify the antenna orientation relative to the radiation pattern. In FIGS. 6A, 6B, 8A, and 8B, the radiation patterns are shown in broken lines, as the dashed lines in bold forming circles in those figures are used in the software to help visualize and report some other parameters of the pattern performance, which are not of significant importance or relevance to the present disclosure.

The radiation patterns shown in FIGS. 6 through 9 were simulated in an RF Electromagnetic software tool in order to better allow one to see the radiation patterns that are not easily measured on a two-dimensional range. As noted above, the radiation patterns are shown in broken lines in FIGS. 6 through 9. The dashed line in bold forming a circle is used in the software to help visualize and report some other parameters of the pattern performance not used herein. Specifically, the dashed line forming a circle can be used to read Front-to-Back ratio, however, the antenna 100 does not generally have a well defined Front-to-Back ratio in all planes, so the dashed line can be ignored for purposes of the present disclosure. To produce this simulated radiation patterns, the antenna is modeled in a free space condition (similar to when measured in an anechoic chamber). The peak of the beam is inclined at an angle of approximately 45 degrees relative to the ground plane, with a peak gain of approximately 3 to 4 (in decibels referenced to isotropic gain (dBi)). According to exemplary embodiments disclosed herein, the radiation patterns of the antenna elements are designed to radiate at an angle that is inclined relative to the back surface of the antenna so that when the antenna is mounted on a ceiling or overhead area, the energy is directed downwards to a coverage area that is conical in shape. In such exemplary embodiments, the antenna is not designed to radiate with the peak of the beam in the horizontal plane.

Numerical dimensions, values, and specific materials are provided herein for illustrative purposes only. The particular dimensions, values and specific materials provided herein are not intended to limit the scope of the present disclosure.

Terms such as "upper," "lower," "inner," "outer," "inwardly," "outwardly," and the like when used herein refer to positions of the respective elements as they are shown in the accompanying drawings, and the disclosure is not necessarily limited to such positions. Terms such as "first," "second," and other numerical terms when used herein do not imply a sequence or order unless clearly indicated by the context.

When introducing elements or features and the exemplary embodiments, the articles "a," "an," "the" and "said" are intended to mean that there are one or more of such elements or features. The terms "comprising," "including," and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

The foregoing description of the embodiments of the present invention has been provided for purposes of illustration and description. It is not intended to be exhaustive or to limit the invention to the precise forms disclosed. Individual elements or features of a particular embodiment are generally not limited to that particular embodiment, but, where applicable, are interchangeable and can be used in a selected embodiment, even if not specifically shown or described.

What is claimed is:

1. An omnidirectional multiple input multiple output (MIMO) antenna with polarization diversity, the antenna comprising:

at least one array of radiating antenna elements having a linear horizontal polarization and configured for radiating omnidirectionally in azimuth;

at least one radiating antenna element spaced-apart from the array and having a linear vertical polarization and configured for radiating omnidirectionally in azimuth;

whereby the antenna is operable for producing:

omnidirectional, vertically polarized coverage for at least one port; and omnidirectional, horizontally polarized coverage for at least one other port.

2. The antenna of claim 1, wherein the array includes horizontally polarized dipole elements.

3. The antenna of claim 1, further comprising a network for feeding the radiating antenna elements.

4. The antenna of claim 1, wherein:

the array includes first, second, third, and fourth horizontally polarized dipole elements;

the first and third horizontally polarized dipole elements are generally facing each other and generally orthogonal to the second and fourth horizontally polarized dipole elements; and the second and fourth horizontally polarized dipole elements are generally facing each other and generally orthogonal to the first and third horizontally polarized dipole elements.

5. The antenna of claim 1, wherein the at least one vertically polarized radiating antenna element includes:

a first radiating antenna element having a linear vertical polarization and operable for radiating omnidirectionally in azimuth; and a second radiating antenna element having a linear vertical polarization and operable for radiating omnidirectionally in azimuth.

6. The antenna of claim 5, wherein the array is spaced apart from and generally between the first and second vertically polarized radiating antenna elements.

7. The antenna of claim 6, wherein:

the antenna includes first, second, and third ports;

the antenna is operable for producing omnidirectional, vertically polarized coverage for the first and third ports; and the antenna is operable for producing omnidirectional, horizontally polarized coverage for the second port.

8. The antenna of claim 1, wherein the at least one array includes:

a first array of radiating antenna elements having a linear horizontal polarization and configured for radiating omnidirectionally in azimuth; and a second array of radiating antenna elements having a linear horizontal polarization and configured for radiating omnidirectionally in azimuth.

9. The antenna of claim 8, wherein the vertically polarized radiating antenna element is spaced apart from and generally between the first and second arrays.

10. The antenna of claim 9, wherein:

the antenna includes first, second, and third ports;

the antenna is operable for producing omnidirectional, horizontally polarized coverage for the first and third ports; and the antenna is operable for producing omnidirectional, vertically polarized coverage for the second port.

11. The antenna of claim 1, wherein:

the antenna includes first, second, and third ports;

the first, second, and third ports are linearly aligned in a row with the second port between the first and third ports; and the second port is generally equidistant from the first and third ports.

12. The antenna of claim 1, wherein at least one port includes an electrical connector comprising at least one of:

a coaxial cable connector; or at least one ISO standard electrical connector; or a Fakra connector; or an SMA female or male connector portion; or an I-PEX connector; or a MMCX connector; or a male or female connector portion configured for making a pluggable electrical connection with a corresponding male or female connector portion disposed at an end of at least one communication link.

13. The antenna of claim 1, wherein the radiating antenna elements are configured such that the antenna has spatial diversity and polarization diversity.

14. The antenna of claim 1, further comprising one or more mounting clips for mounting the antenna to supporting structure with the antenna suspended from the supporting structure.

15. The antenna of claim 1, further comprising:

a plurality of ceiling mounting clips for mounting the antenna to the ceiling of a room; or a frame style mount for wallboard or other non-gridded ceiling systems.

16. The antenna of claim 1, further comprising means for mounting the antenna to supporting structure with the antenna suspended from the supporting structure.

17. The antenna of claim 1, further comprising a ground plane for electrically grounding the radiating antenna elements.

18. The antenna of claim 1, further comprising an electroconductive plate operable for electrically grounding the radiating antenna elements, and a radome coupled to the plate with the radiating antenna elements enclosed within the internal spaced cooperatively defined between the radome and plate.

19. The antenna of claim 1, wherein:

the antenna has a length of about 208 millimeters, a width of about 104 millimeters, and a thickness of about 36 millimeters;

the antenna is configured such that voltage standing wave ratio is about 2:1 or less for an operating frequency between about 2.4 GHz and 2.5 GHz; and/or the antenna is configured such that gain with a 60-inch cable is about 3 dBi for the operating frequency between about 2.4 GHz and 2.5 GHz; and/or the antenna is configured such that the azimuth beamwidth is omnidirectional and the elevation beamwidth is about 55 degrees nominal.

20. The antenna of claim 1, further comprising a printed circuit board including a transmission line in communication with feed points of the array of radiating antenna elements for feeding the array of radiating antenna elements.

21. The antenna of claim 1, wherein each port is provided with omnidirectional coverage by the antenna.

22. An omnidirectional multiple input multiple output (MIMO) antenna with polarization and spatial diversity and operable for producing omnidirectional, vertically polarized coverage for at least one port and omnidirectional, horizontally polarized coverage for at least one other port, the antenna comprising:

at least one array of horizontally polarized dipole elements having a linear horizontal polarization and configured for radiating omnidirectionally in azimuth, the array including first, second, third, and fourth horizontally polarized dipole elements, the first and third horizontally polarized dipole elements are generally facing each other and generally orthogonal to the second and fourth horizontally polarized dipole elements, and the second and fourth horizontally polarized dipole elements are generally facing each other and generally orthogonal to the first and third horizontally polarized dipole elements;

first and second radiating antenna elements spaced-apart from the array such that the array is generally between the first and second vertically polarized radiating antenna elements; the first and second radiating antenna elements having linear vertical polarizations and configured for radiating omnidirectionally in azimuth; and first, second, and third ports linearly aligned in a row with the second port between the first and third ports and generally equidistant from the first and third ports.

* * * * *